United States Patent [19]

Rensch et al.

[11] 4,128,831

[45] Dec. 5, 1978

[54] DEVICE FOR THE CONTINUOUS MONITORING OF OIL LEAKS ON OXYGEN COMPRESSORS

[75] Inventors: Adam Rensch, Frankenthal; Otto Albert, Weinheim, both of Fed. Rep. of Germany

[73] Assignee: BASF Aktiengesellschaft, Ludwigshafen, Fed. Rep. of Germany

[21] Appl. No.: 730,283

[22] Filed: Oct. 6, 1976

[30] Foreign Application Priority Data

Oct. 7, 1975 [DE] Fed. Rep. of Germany ..... 2544730

[51] Int. Cl.[2] ..... G08B 21/00; F01B 31/12

[52] U.S. Cl. ..... 340/605; 92/5 R; 92/86; 340/612

[58] Field of Search ..... 340/242; 92/5 R, 86; 91/1

[56] References Cited

U.S. PATENT DOCUMENTS

| | | | |
|---|---|---|---|
| 570,726 | 11/1896 | Butts | 92/86 |
| 2,050,521 | 8/1936 | Chapin | 340/242 X |
| 3,841,204 | 10/1974 | Bennett et al. | 92/86 |
| 3,868,890 | 3/1975 | Roberts et al. | 92/5 R |

*Primary Examiner*—John W. Caldwell, Sr.
*Assistant Examiner*—Daniel Myer
*Attorney, Agent, or Firm*—Keil, Thompson & Shurtleff

[57] ABSTRACT

A safety device and monitoring device — for use with piston-type and turbo-type oxygen compressors — for oil leakage at the seals of the machine, comprising at least one collecting element for leakage oil, which is introduced into a vessel in which it actuates a signal device.

5 Claims, 7 Drawing Figures

DEVICE FOR THE CONTINUOUS MONITORING OF OIL LEAKS ON OXYGEN COMPRESSORS

The invention relates to an adaptable arrangement for monitoring the leakage of oil at the seals or packings of oxygen compressors, which arrangement can be fitted both to the piston rods of piston machines and to the rotary shafts of turbo-compressors and helps to avoid acute fire hazards of such machines.

Oxygen compressors can be responsible for fires which at times cause considerable physical injury and material damage. It is true that in order to prevent breakdown and damage generally, and fires in particular, oxygen compressors are fitted with numerous safety devices and shut-off devices, e.g. temperature monitoring instruments, manometers, soldered connections which melt at certain temperatures, photocells and vibration detectors, the parameters and responses of which are fed to a control center. Frequently, however, fires are not detected sufficiently early for it still to be possible to prevent the flames from spreading outside the zone in which the fire started. As a result of the rapid spread of fire, the damage is in most cases so great that the exact cause of the fire can no longer be determined with certainty.

The appreciation of the fact that, when compressing oxygen, the occurrence of fires cannot be prevented with absolute certainty has resulted, inter alia, in the compressor installations being provided at least partially with partitions. Furthermore, a working party formed by manufacturers and operators of oxygen compressor installations has laid down guidelines for the operation of such installations, which define a danger zone around the installations and furthermore recommend that oxygen compressor installations should be completely enclosed in strong partitions. Given this arrangement, the access to the danger zone should be greatly restricted as long as the compressor is transporting oxygen. This danger situation also exists for piston compressors, regardless of whether they use a labyrinth-seal piston or a teflon ring piston. However, given restricted access to the danger zone of the compressor box, the controls hitherto conducted empirically directly on the machine can no longer be carried out and must be replaced by further monitoring instruments with remote indicators. The most important of such additional control devices are concerned with the proper functioning of the inlet valves and discharge valves, the recording of the pressures and temperatures of the compressed oxygen and the observation of either the piston rod or the drive shaft of the compressor, in order to detect any oil leakages.

The operating valves can readily be monitored by, for example, measuring the temperature at each individual valve by means of thermocouples or resistance thermometers, comprising a remote indicator. Equally, the pressures and temperatures of the compressed oxygen and of the cooling water can be readily shown on remote-indicating equipment. However, the measures and means hitherto disclosed for controlling the piston rods and drive shafts of oxygen compressors installed in safety boxes, in order to detect any oil leaks, are unsatisfactory. For example, small windows of safety glass for observing the piston rods have been set into the protective walls of the boxes. Since, however, the distance from the window to the piston rod is relatively large, drops of oil are very difficult to recognize, in spite of bright supplementary lighting, particularly in the critical areas in the vicinity of the seals. Frequently, stuffing boxes of the machine cannot be observed at all because small windows provide an unsuitable angle of vision. It has also been disclosed to irradiate the piston rods with UV light in order to make leakage oil more readily visible. In this case, again, the inadequate lighting and the limited scope for observation are unsatisfactory because, when using UV light, the adjacent areas must be substantially dark. Furthermore, such observations, which in any case are very unreliable, can only be carried out a few minutes per shift, so that a critical oil leak is frequently observed too late.

The place at which an oil leak must be detected rapidly is the seal, surrounding either a piston rod or shaft, which is intended to prevent the leakage of lubricating oil. A slight film of oil, for example on the piston rod of a compressor, between the oil wiping ring and the splash ring, is unobjectionable as long as the oil is prevented from creeping into the stuffing box behind which there is oxygen under pressure. The same general remarks apply to turbo-compressors and their shafts and shaft seals.

It is an object of the present invention to provide measures and means by which, during continuous operation of oxygen compressors, even small amounts of leakage oil — for example due to inadequate oil wiping in front of the seal which serves to contain the oxygen pressure — can be detected and indicated or signalled, and, as a further consequence, the compressor can automatically be shut down. A device for achieving the object of the invention accordingly requires an oil-actuated triggering element and an indicating or signalling device. Such triggering elements are well-known in the art as, for example, is disclosed in U.S. Pat. Nos. 3,751,616 and 3,944,844, which are incorporated by reference herein.

We have found that this object is achieved by a collecting element for leakage oil and splashed oil, which element is of shield-like shape, has an open collecting channel, and surrounds, from all sides, the reciprocating or rotating machine component of the compressor in the vicinity of the oil-blocking seal, the collecting channel having one or more orifices from which the collected leakage oil or splashed oil enters one or more vessels which trigger a signal. The shield-like collecting element, provided with a collecting channel, either surrounds the piston rod of a piston compressor in the vicinity of the oil-blocking stuffing box or the rotating shaft of a turbo-compressor in the vicinity of the labyrinth-seal or slip-ring seal which prevents leakage of bearing oil.

Further characteristics of the invention will emerge from the description which follows, together with the drawings.

FIG. 1 schematically shows the device on the vertically moving piston rod of a piston compressor, between the crank case and the oxygen stuffing box of the machine;

Figure 1:
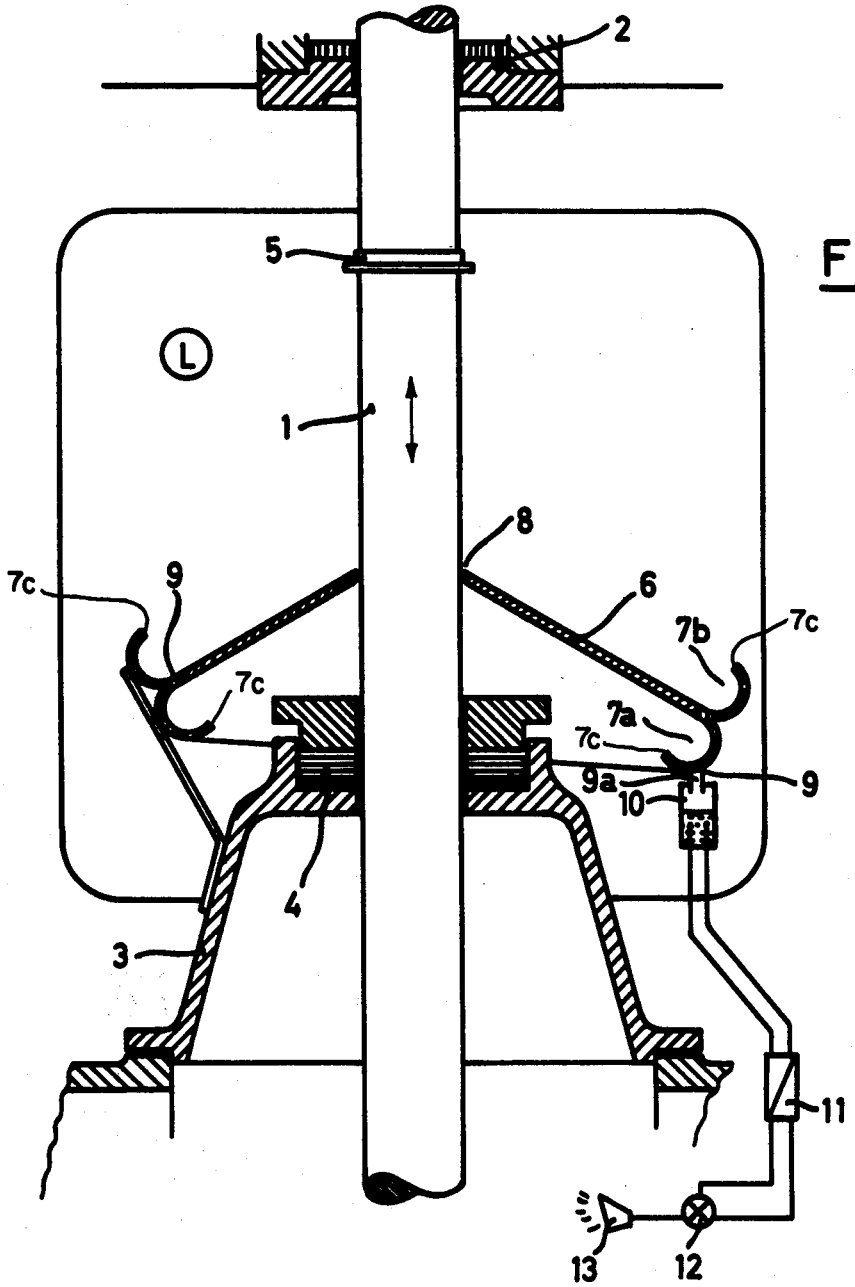
Figure 7:
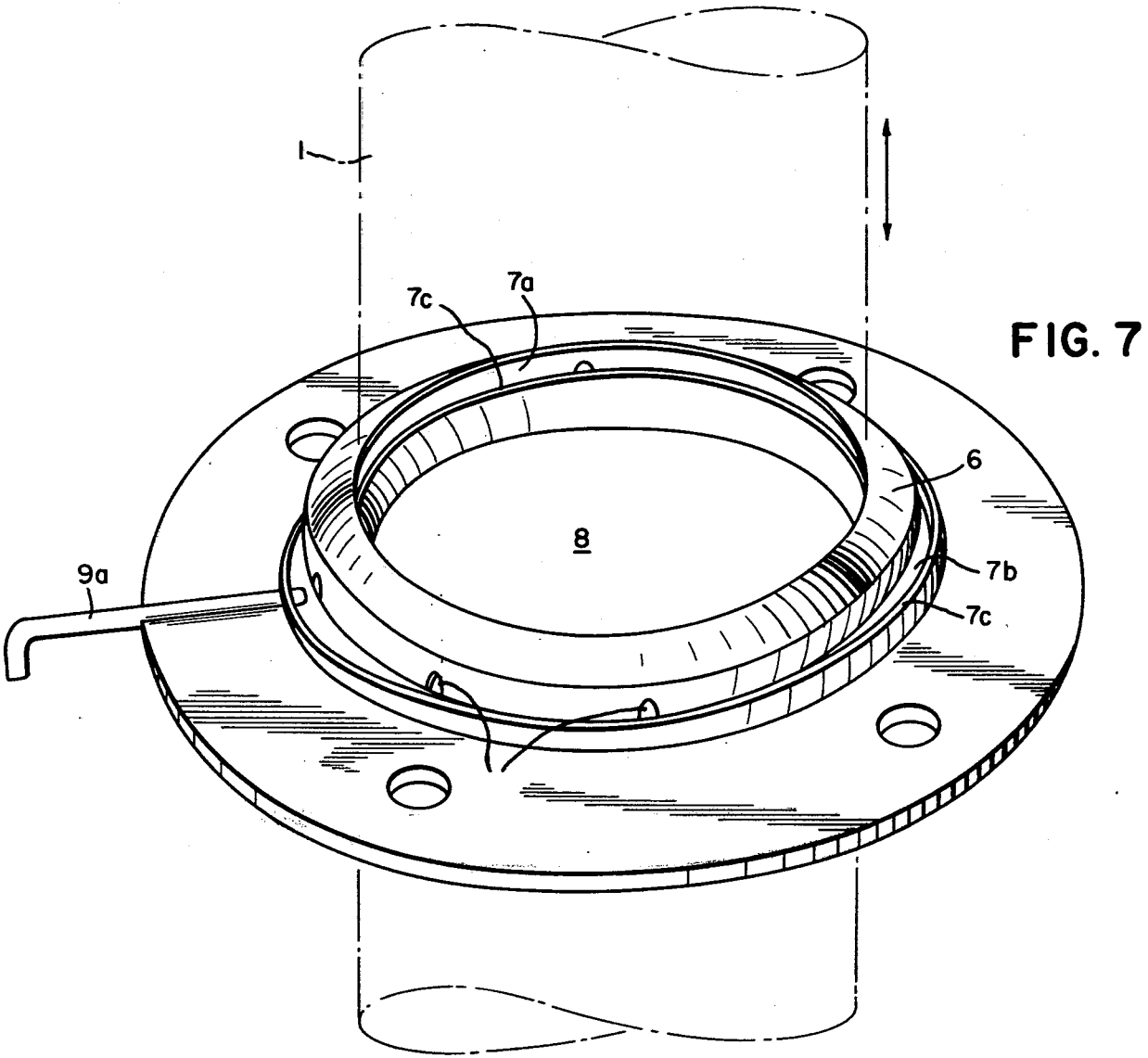
FIG. 7 is a perspective view of an embodiment of the device similar to that illustrated in FIG. 1 showing the collecting element completely surrounding the vertically moving piston rod.

FIGS. 1 and 7 show a piston compressor with a vertically moving piston rod 1 and a stuffing box 2, which provides a seal against the oxygen pressure. Not even traces of lubricating oil are allowed to enter this stuffing box. Where the piston rod 1 passes through the crank case 3, one or more conventional oil wiper elements 4 are provided, and at least one splash ring 5 is mounted on the piston rod itself. Monitoring by visual observation — which can only be carried out at short intervals — of the running of the machine frequently is insufficient to adequately minimize the fire hazard if oil should penetrate in the direction of the oxygen stuffing box 2. According to the invention, a collecting element 6 with a single or double peripheral inclined collecting channel 7a, 7b on its outer rim which terminates in an inwardly-directed lip portion 7c which substantially surrounds and is spaced from the piston rod 1, is fixed to the crank case 3 in the zone between the oxygen stuffing box 2 and the oil stripper elements 4, i.e. approximately in the bonnet L of the piston compressor. The size of the plate-like collecting element 6 is chosen in accordance with the dimensions of the machine. The central hole 8 of the collecting element 6 surrounds the piston rod 1, leaving a narrow gap. One or more orifices 9 are provided in the collecting channels 7a, 7b of the collecting element 6, as a result of which the leakage oil or splashed oil collected over the entire surface of the collecting element eventually passes through an orifice at the lowest level, provided with a pipe attachment 9a, into a closed vessel 10 below the said orifice. In the interior of the vessel 10, electrical components are provided, which, when a predetermined level is reached, actuate acoustic and optical indicating and signalling devices 11, 12 and 13 and, if required, cause the compressor to stop automatically. Two embodiments of the closed vessel 10 which collects the leakage oil and splashed oil are described in more detail below.

Figure 2:
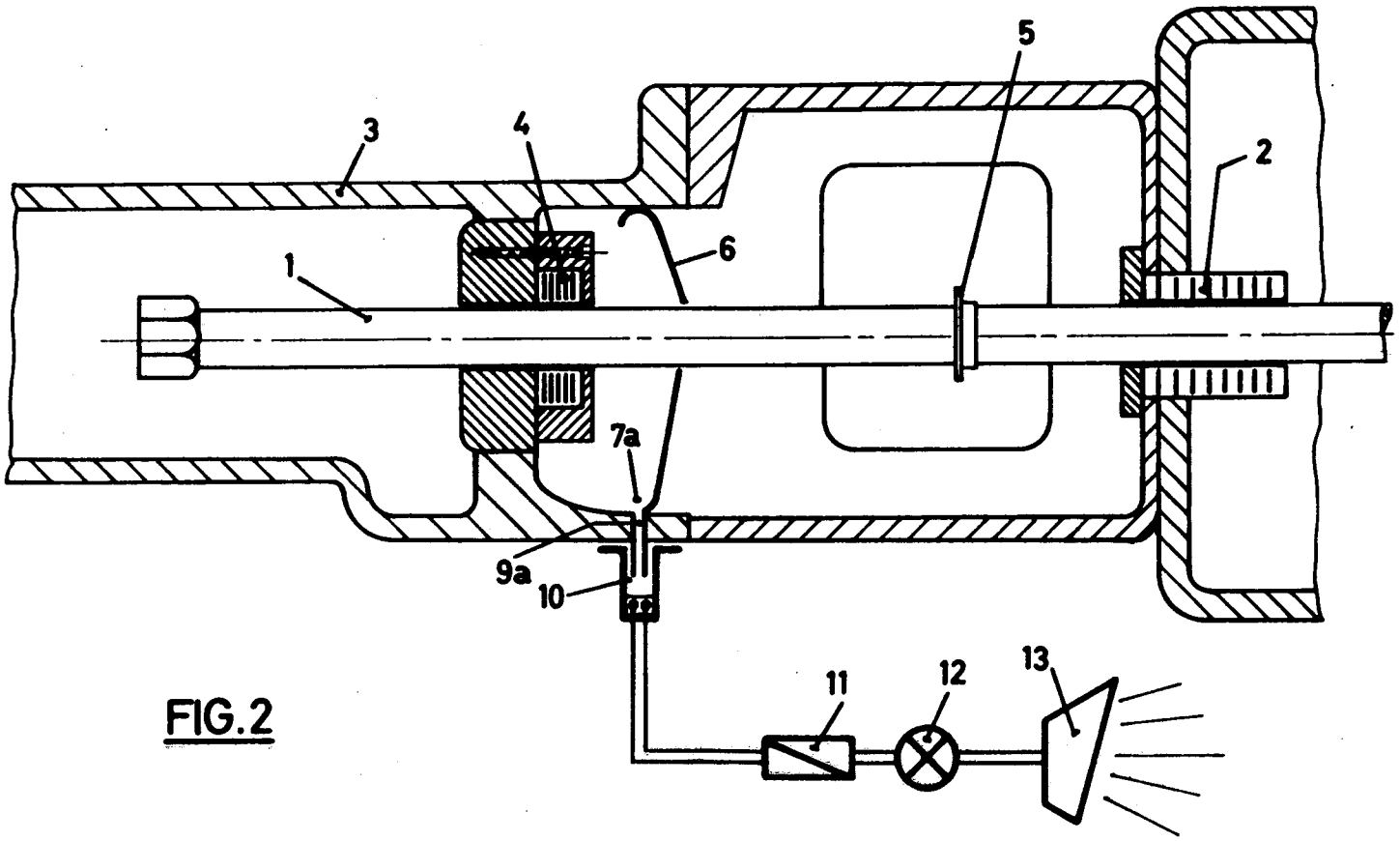
FIG. 2 shows the corresponding device on a horizontally moving piston rod of a compressor.

FIG. 2 shows a similar piston compressor with a horizontally moving piston rod. The position of the oil wiping elements 4 and the crank case orifice relative to the stuffing box 2, which provides a seal from the oxygen pressure, and the collecting element 6, which surrounds the piston rod 1 on all sides, for any leakage oil or splashed oil which may issue is the same as in the machine shown in FIG. 1. In this case, the collecting element 6 only has one collecting channel 7 and its outer rim touches the inner wall of the machine housing 3, without leaving a gap, and is detachably fixed thereto. If necessary, the lower region of the housing 3 is appropriately inclined. The hole 9 at the lowest point of the collecting channel is connected, through a length of pipe 9a, which passes through the wall of the housing, with the closed vessel 10, in this case fixed to the outside of the machine housing, which accommodates the signal-actuating device which is triggered by leakage oil.

Figure 3:
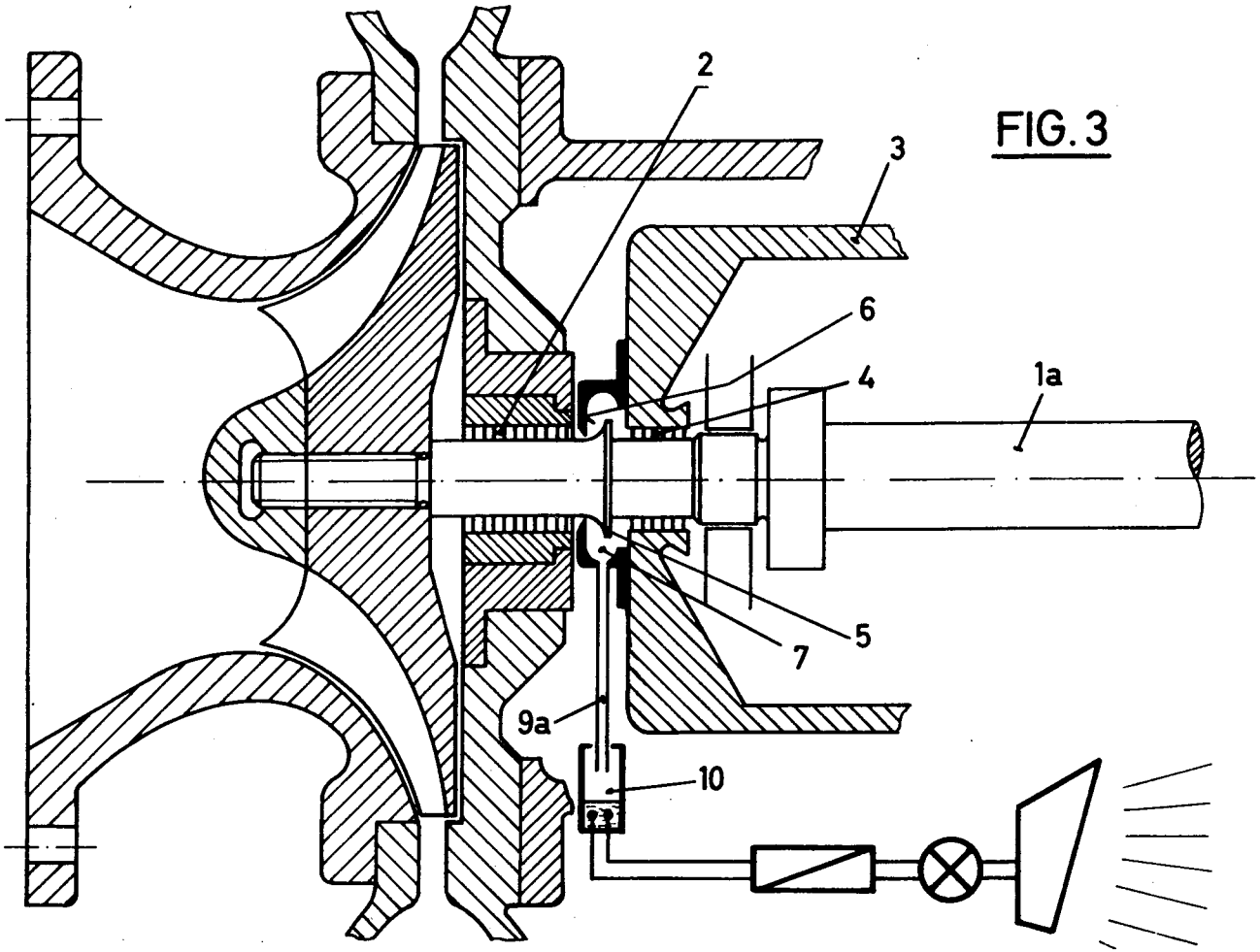
FIGS. 3 and 4 show the device respectively on a one-stage and a multi-stage turbo-compressor.
Figure 4:
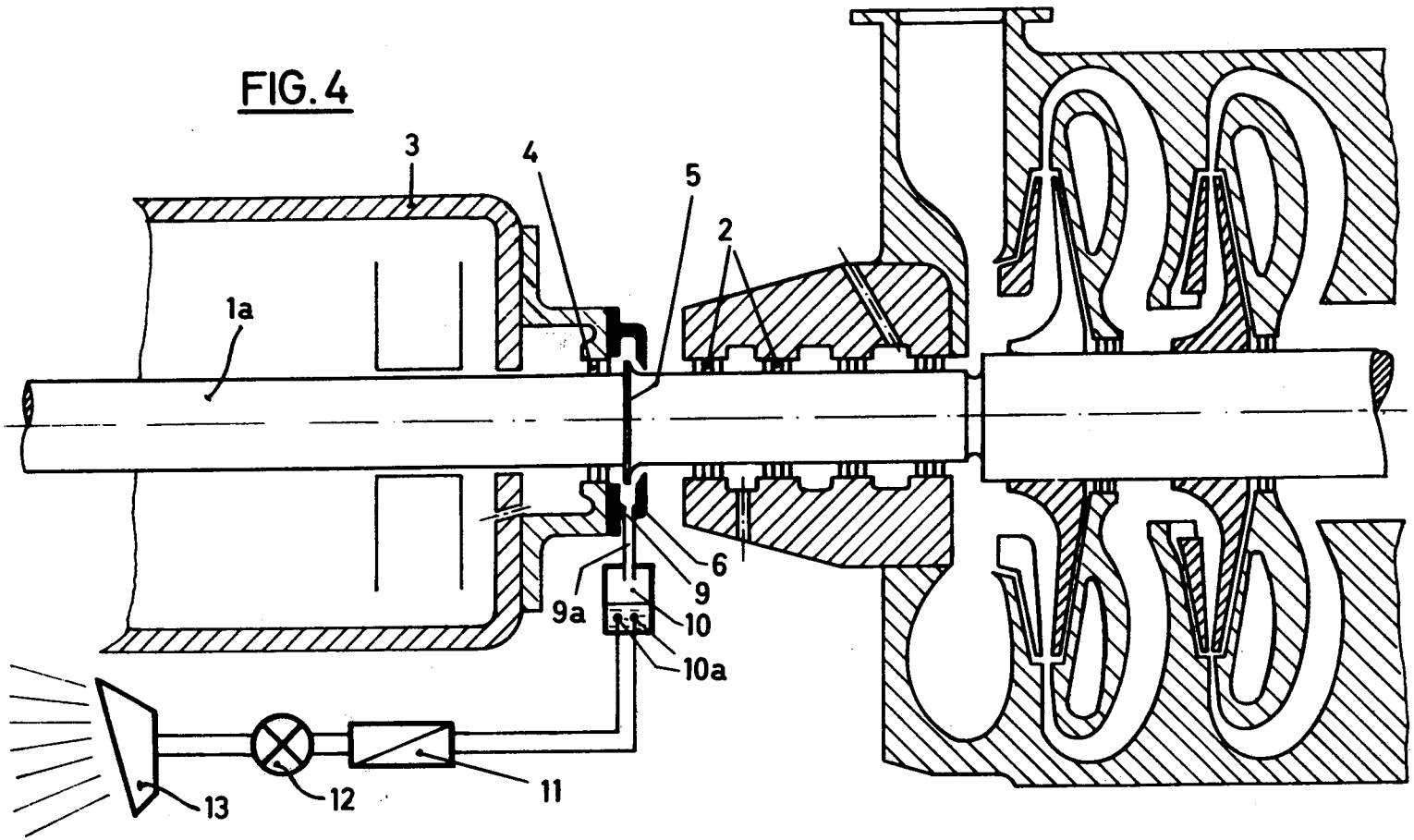

FIGS. 3 and 4 show embodiments of the invention relating to a single-stage or multi-stage oxygen turbo-compressor. The compressor shaft 1 is provided, between the stuffing box 2 which provides a seal from the oxygen pressure and the element 4 which strips off exuding bearing oil, with a splash ring 5 of larger diameter, and the collecting element 6, provided with the collecting channel 7, is fixed to the housing 3 in the plane in which the splash ring 5 functions. In this case, the collecting element is a hollow body, provided with central orifices for the shaft 1, and the collected leakage oil or splash oil passes, from the orifice 9 provided at the lowest point of the hollow body, through a length of pipe 9a into the closed vessel 10 containing the means which trigger the signal.

Figure 5:
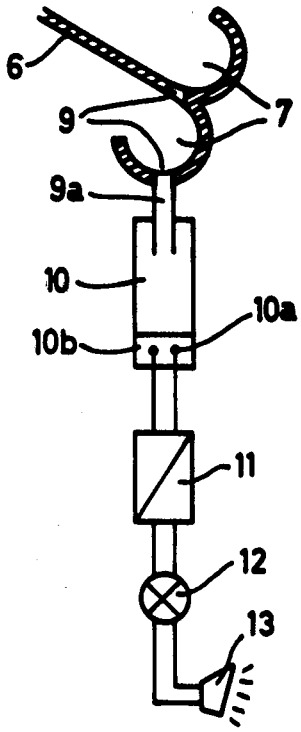
FIGS. 5 and 6 show, on an enlarged scale, the vessels connected to the orifices in the collecting channels, together with the oil-triggered signalling devices.
Figure 6:
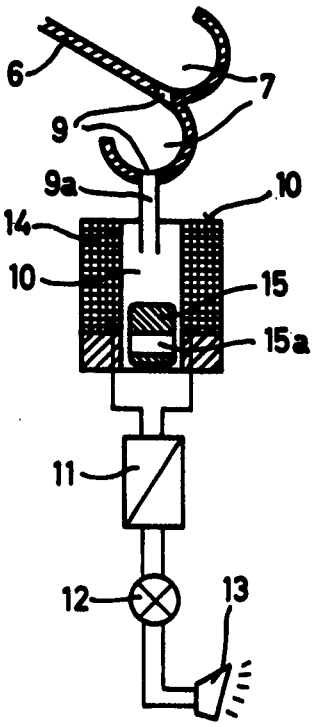

The oil level-dependent signal triggering device of the vessel 10 may be of various electrical constructions. Preferably, a conductive or inductive closed circuit is formed with a relay 11; when a preselected amount of leakage oil has entered the vessel 10, the circuit is disturbed and then causes the signalling components 12 and 13 to respond. According to FIG. 5, a pair of contacts 10a is provided in a fluidized electrically conductive contact composition 10b in the vessel 10; the contact composition cuts the connection of the contacts 10a when oil enteres. According to FIG. 6, a circuit for triggering the signalling components 12 and 13 is inductively influenced. For this purpose, a coil 14 is provided in the vessel 10, and as the leakage oil level rises a ferromagnetic core 15a fixed to a float 15 enters the coil and electrically trips the relay 11. If, for example, in the event of defective stripping of oil from the crank case of a piston compressor, or in the event of exudation of bearing oil from a turbo-compressor, oil is thrown in the direction of the seal 2 which shuts off the oxygen under pressure, the oil is collected by the collecting element 6, runs through the collecting channel 7 or 7a, 7b into the closed vessel 10 and triggers the signalling device. The resulting electrical disturbance is indicated optically and/or acoustically in the control room of the oxygen compressor and, if desired, the machine is automatically stopped or switched over to another medium to be compressed, e.g. air or nitrogen.

We claim:

1. A device for continuously monitoring the occurrence of oil leakage about the shaft seals of oxygen compressors having reciprocating or rotating shafts, said device comprising:
   - a collecting element surrounding the shaft from all sides in the vicinity of the shaft seals,
   - a collecting channel having one or more orifices formed therein located about the periphery of said collecting element, said collecting channel terminating in an inwardly-directed lip portion which substantially surrounds and is spaced from said shaft,
   - a vessel means located below said orifices for accumulating said oil leakage from said collecting element and channel, and
   - an electrical triggering means for actuating a signal when said oil leakage accumulating in said vessel reaches a predetermined amount.

2. The device as claimed in claim 1 wherein the collecting element and collecting channel have a predetermined surface area and surround the reciprocating piston shaft of a piston compressor on all sides in the vicinity of the oil-blocking shaft seal.

3. The device as claimed in claim 1 wherein the collecting element surrounds on all sides the rotating shaft of a turbo-compressor in the vicinity of the shaft seal which prevents the exudation of bearing oil.

4. The device as claimed in claim 3 wherein the collecting element is aligned with the plane of a splash ring mounted on said rotating shaft.

5. The device as claimed in claim 1 wherein said vessel means is connected indirectly via a length of pipe to the orifice formed in said collecting channel.

* * * * *